US006395153B1

(12) United States Patent
Matousek et al.

(10) Patent No.: US 6,395,153 B1
(45) Date of Patent: May 28, 2002

(54) DIAPHRAGM CELL

(75) Inventors: Rudolf C. Matousek; Mark L. Arnold, both of Chagrin Falls; Barry L. Martin, Concord; Eric J. Rudd, Painesville; Lynne M. Ernes, Willoughby; Zoilo J. Colon, Chardon; Gary F. Wyman, Painesville; Joseph J. Chance, Mentor, all of OH (US)

(73) Assignee: Eltech Systems Corporation, Chardon, OH (US)

( * ) Notice: Subject to any disclaimer, the term of this patent is extended or adjusted under 35 U.S.C. 154(b) by 0 days.

(21) Appl. No.: 09/655,967

(22) Filed: Sep. 10, 1999

Related U.S. Application Data

(60) Provisional application No. 60/110,577, filed on Dec. 2, 1998.

(51) Int. Cl.[7] ..... C25B 9/00

(52) U.S. Cl. ..... 204/252; 204/283; 204/290.01; 204/290.14; 204/296; 205/498; 205/508; 205/510; 205/516; 205/517; 205/518; 205/519; 205/526; 205/531; 205/532; 205/535

(58) Field of Search ..... 204/252, 283, 204/284, 290.01, 290.14, 296; 205/498, 508, 510, 516, 517, 518, 519, 526, 531, 532, 535

(56) References Cited

U.S. PATENT DOCUMENTS 4,444,640 A * 4/1984 Tsai et al. ..... 204/283
4,557,810 A * 12/1985 Beaver et al. ..... 204/283
4,853,101 A * 8/1989 Hruska et al. ..... 204/296
4,879,009 A * 11/1989 Kinney ..... 204/283
4,900,408 A * 2/1990 Powers ..... 204/283
6,059,944 A * 5/2000 DuBois et al. ..... 204/296

FOREIGN PATENT DOCUMENTS

RU 1201351 A 7/1984
RU 0 627 501 A2 5/1994

OTHER PUBLICATIONS

Manufacture Specifications of the diaphragm cell with Metal Anodes, Sep. 12, 1988.

* cited by examiner

*Primary Examiner*—Bruce F. Bell
(74) *Attorney, Agent, or Firm*—Michele M. Tyrpak; Hudak & Shunk Co., LPA

(57) ABSTRACT

The present invention pertains to electrolytic diaphragm cells, particularly for the electrolysis of brine to produce chlorine and caustic. The innovation resides generally in the discovery that electrolytic cell operation can be desirably enhanced by compressing the diaphragm between anode and cathode. This compression of the diaphragm reduces the diaphragm thickness from an original thickness, e.g., from an original thickness of a diaphragm freshly deposited on a cathode. The reduced thickness of the diaphragm provides for cell operation that is less than zero gap operation. By maintaining the diaphragm under compression and in a reduced thickness, the cell operates with a narrower inter-electrode gap and consequently at a desirably reduced cell voltage.

40 Claims, 1 Drawing Sheet

PRIOR ART: 2mm THICK DIAPHRAGM ON CATHODE
INVENTION: COMPRESSED DIAPHRAGM FILLS THE GAP
DIAPHRAGM THICKNESS REDUCED 1mm BY COMPRESSION

DIAPHRAGM CELL

CROSS-REFERENCE TO RELATING APPLICATION

This application claims the benefit of U.S. Provisional Application No. 60/110,577 filed Dec. 2, 1998.

BACKGROUND OF THE INVENTION

1. Field of the Invention

The present invention relates to the field of electrolytic diaphragm cells and those which are particularly useful for the production of chlorine and caustic. The invention provides for a reduction in the cell voltage of the diaphragm cell.

2. Description of the Related Art

The diaphragm type electrolytic cell has found wide commercial use, such as for the electrolysis of brine to produce chlorine and caustic. The industry is constantly faced with the challenge of reducing operating expenses, including the cost of electric power. Efforts thus continue to be focused on increasing the efficiency of brine electrolysis.

On the one hand, it has been recognized that in operating these cells, it will be desirable to keep the anode-cathode gap small, since the resistance of the electrolyte in the gap contributes an ohmic over potential to the overall cell voltage. The cell voltage generally decreases linearly with the decrease of the anode-cathode gap. However, on the other hand, it has been stated that for anode-cathode distances below a limit of about 3.5–4 mm, the cell voltage remains more or less constant or may even increase (see Winings et al in *Modern Chlor-Alkali Technology*, 1980, pages 30–32).

Thus, it has been proposed to narrow this gap, as by moving the anode close to the diaphragm, but use an anode support member between the anode and the diaphragm to keep the anode from directly contacting the diaphragm. This approach has been taken in the innovation described in U.S. Pat. No. 3,242,059. As disclosed therein, a foraminous sheet of titanium is employed as an anode support. A side of this sheet is in contact with the diaphragm. An opposite side of the sheet has a coating, such as of platinum, that serves as the anode.

Along this same line, it has also been proposed to interpose a net between the anode and the diaphragm. This has been taught in U.S. Pat. No. 4,014,775. The net spaces the anode apart from the diaphragm by the thickness of the net, i.e., the spacing between the anode and the cathode is comprised of the thickness of the diaphragm plus that of the net.

In the continuing development of anode technology, the innovation of the expandable anode has experienced great commercial success. Expandable anodes have been described, for example, in U.S. Pat. No. 3,674,676. These expandable anodes have a shape somewhat like a hollow cereal box, i.e., minus its top and bottom, and may be referred to herein as expandable anodes. The anode surfaces can be kept in a contracted position, by the use of retainers, while the anode is inserted between cathodes. By removing the retainers, the anode surfaces are released and moved toward the surface of the diaphragms, which diaphragms may be deposited on the cathode.

Along with the development of the expandable anode, efforts continued toward the development of diaphragms having desirable stability in extended cell operation, and which diaphragms can serve while in direct contact with the anode surface. This is referred to as zero gap operation. Such zero gap operation has been achievable with an improved, resin reinforced, asbestos diaphragm such as disclosed in U.S. Pat. No. 4,563,260.

Even for these anodes of the expandable type, it has been found to be useful to place between the diaphragm and the anode an additional member. Thus, there has been disclosed, in European patent application No. 0 611 836 A1, the placement of a thin, expanded mesh on an anode that is a coarse mesh anode. By extending the expandable anode and this fine mesh surface against the diaphragm, the diaphragm retains its original thickness and does not undergo any volume expansion. Also, in this dual structure, the pressure exerted may pressingly increase fiber cohesion and thereby enhance fiber retention in the diaphragm during cell operation.

It would nevertheless be desirable to further improve the operating efficiency of a diaphragm cell. It would be particularly desirable to improve such efficiency by a further reduction in the cell voltage. It would also be desirable to achieve this additional operating efficiency while at the same time obviating any problem of a constant cell voltage, or even increase in cell voltage, that can be encountered as the anode-cathode distance is decreased below a limit of about 3–4 mm.

SUMMARY OF THE INVENTION

A reduction in cell voltage of a diaphragm cell has now been achieved. This has been obtained without occasioning any problems associated with a more or less constant cell voltage, or even cell voltage increase, as can be encountered as the anode-cathode distance is reduced below a certain limit. The present invention is suitable for utilization with structures including expandable anodes which may or may not include a fine or compressible material, as an intermediate element, located between the anode and the diaphragm. The invention can be serviceable in such structures where an intermediate element, if present, may or may not be coated. The invention resides generally in the discovery that cell operation that is not only non-detrimental, but is also enhanced, can be achieved by permitting compression of the diaphragm. This compression provides for cell operation that can be described as less than zero gap operation. The innovation achieves a highly desirable reduction in the cell voltage of the diaphragm cell. This reduction in cell voltage can be obtained so that a measurable lower overall power consumption can be achieved.

In one aspect, the invention pertains to an electrolytic diaphragm cell having a diaphragm interposed between electrodes of the cell, such cell comprising an anode assembly having at least one anode contacting the diaphragm and a cathode assembly having at least one cathode contacting the diaphragm, with the anode and the cathode providing an interelectrode gap, which interelectrode gap contains the diaphragm, with the diaphragm having an original and uncompressed thickness within the electrode gap as a first thickness, the improvement in such cell comprising a diaphragm compressed by pressing at least one electrode against the diaphragm, which diaphragm is present in the interelectrode gap as a compressed diaphragm of a econd, reduced thickness.

In another aspect, the invention is directed to a method for assembling an electrolytic diaphragm cell for the electrolysis of an aqueous electrolyte, which method comprises:

establishing a metal anode;

providing a metal cathode adjacent the anode, with the cell having an interelectrode gap between the anode and the cathode;

establishing a diaphragm of a first, original and uncompressed thickness within the interelectrode gap between the anode and the cathode; and pressing at least one electrode against the diaphragm and compressing the diaphragm to a second, reduced thickness.

In a still further aspect, the invention is directed to the process wherein an electrolyte is passed into an electrolytic cell and electrolyzed in the cell, and the cell contains a compressible diaphragm positioned between the anode and the cathode, which diaphragm is placed in the cell in a first original and uncompressed thickness, the improvement in the process which comprises electrolyzing the electrolyte in the cell with the cell containing the diaphragm compressed between the anode and the cathode, which diaphragm is compressed to a second, reduced thickness.

DESCRIPTION OF THE PREFERRED EMBODIMENTS

Figure 1:
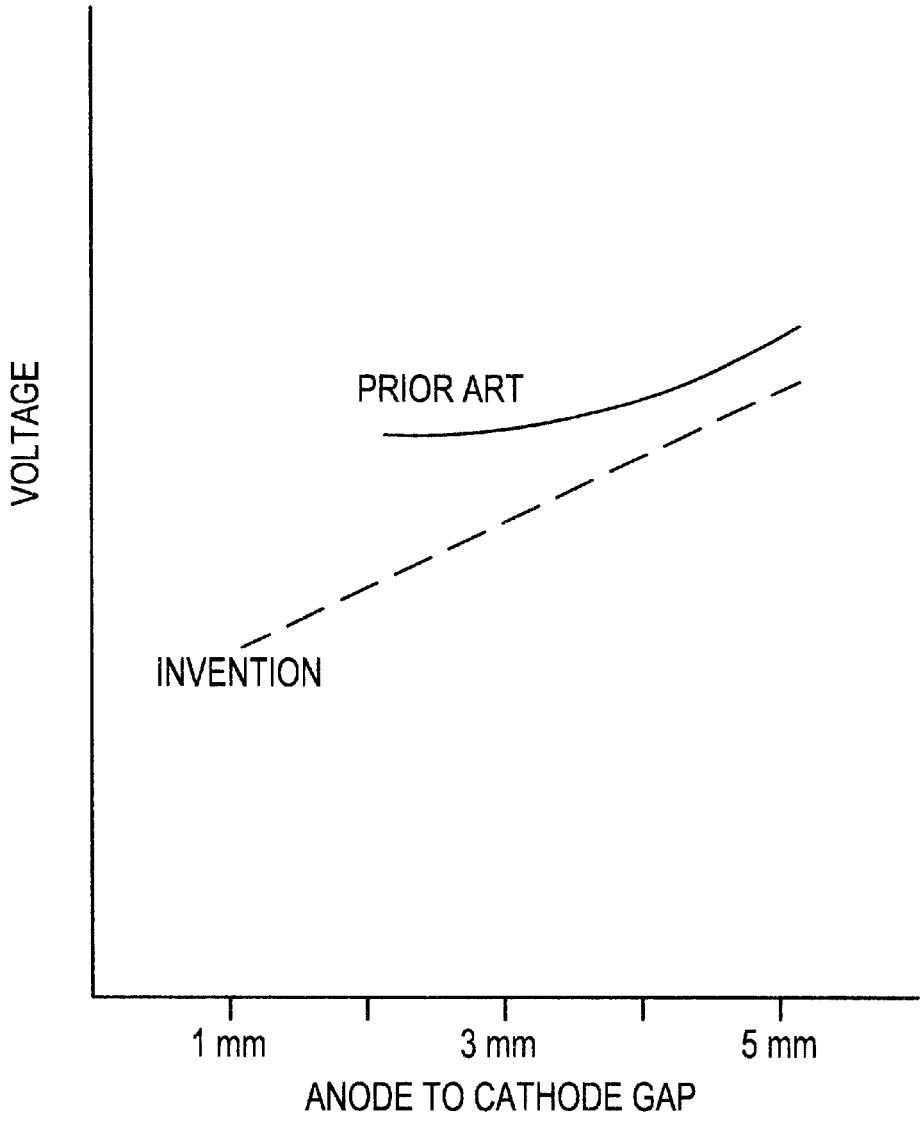
FIG. 1 is a graph showing a relationship between cell voltage and the anode-cathode gap for prior art practice as well as for invention practice with a representative cell having a foraminous mesh electrode.

The present invention can be useful for the electrolysis of a dissolved species contained in a bath, e.g., in an aqueous electrolyte, such as in electrolyzers employed in a chlor-alkali cell to produce chlorine and caustic soda from an alkali metal chloride electrolyte. The electrolyzers can also be useful to produce other alkali metal hydroxides such as potassium hydroxide. Additional uses include recovery of acid and base values from salts such as sodium and potassium sulfates, phosphates and chlorates and include the production of sulfuric acid.

The metal anode assembly can include the anode itself plus other members, e.g., electrical connection means for the anode. The metal anode will most always be of a valve metal, including titanium, tantalum, zirconium and niobium. Of particular interest for its ruggedness, corrosion resistance and availability is titanium. Various grades of titanium metal are available. Advantageously, the titanium used will be grade 1 or grade 2 unalloyed titanium. However, as well as unalloyed metal, the suitable metals of the anode can include metal alloys and intermetallic mixtures, such as contain one or more valve metals. The metal anodes are usually coated with an electrochemically active coating, as will be discussed further on hereinbelow.

The metal anode of the assembly, for convenience, may sometimes be referred to herein as the "foraminous metal anode" or simply the "anode". This foraminous metal anode can be in a form such as an expanded metal mesh, woven wire, blade, rod, grid, perforated metal sheet or punched and pierced louvered sheet.

Where the metal anode used is in a form of a metal mesh, woven wire, perforated plate or the like, such may be referred to herein for convenience as a "foraminous mesh anode" or "foraminous metal mesh anode". One highly serviceable metal anode for use in the present invention is disclosed in U.S. Pat. No. 5,100,525, the disclosure of which is incorporated herein by reference. The patent discloses an anode assembly of the expandable type. The anode surfaces are on opposite sides of an anode conductor bar, with expanders between the anode surfaces and the conductor bar. Each anode surface may comprise multiple anode sheets. However, other anode structures can be serviceable, e.g., slotted plate anodes, or the like, mounted on a support. These anodes, as have been described in U.S. Pat. Nos. 4,121,990 and 4,141,814, can have anode plates that are spaced apart from one another and which may be forced apart, e.g., by wedges, serving as spacers between the plates, to provide anode pressure against a diaphragm.

As the electrode surface, or typically "sheet", of the anode is pressed against the diaphragm, such surface, e.g., for a chlor-alkali cell, must be of the foraminous type to permit withdrawal of the chlorine bubbles towards the brine contained inside the anode. A foraminous metal electrode is generally an expanded metal. The sheets that are expanded to prepare the foraminous electrode may have a thickness of as little as from about 0.1 millimeter (mm) to 0.5 mm. By way of example, the expanded metal can be in typical electrode mesh form, with each diamond of the mesh having an aperture, or void, of about one-sixteenth inch to one-quarter inch or more dimension for the short way of the design (SWD), while generally being about one-eighth to about one-half inch across for the long way of the design (LWD). Such a representative expanded metal mesh can be particularly serviceable as a single sheet anode, as opposed to anodes that are layers of sheets, which anode structure will be more particularly discussed hereinbelow. The expanded metal mesh may be flattened or unflattened.

The metal cathode assembly can include the cathode itself plus other members, e.g., means for electrical connection. The cathode itself can be a foraminous structure and be in a foraminous form as described hereinabove. The cathode is sometimes referred to herein as the "foraminous metal cathode" or simply the "cathode". The foraminous cathode as a foraminous metal mesh cathode may provide good current distribution and gas release. The cathode can, however, be in other foraminous form, such as a foraminous form as mentioned hereinbefore, e.g., it might be a blade grid such as shown in U.S. Pat. No. 4,022,679, or a punched and pierced louvered sheet. The cathode and cathode assembly elements can be made of any electrically conductive metal resistant to attack by the catholyte in the cell. Nickel, steel including stainless steel, as well as their other alloys and intermetallic mixtures, may be advantageously utilized for the cathode.

The active electrode surface area of the cathodes can be uncoated, e.g., a bare, smooth nickel metal cathode, or a ferruginous cathode such as an iron or steel mesh cathode or perforated iron or steel plate cathode. Alternatively, the active surface for the cathode can comprise a coated metal surface. The active surface for the cathode might be a layer of, for example, nickel, molybdenum, or an oxide thereof which might be present together with cadmium. Other metal-based cathode layers can be provided by alloys such as nickel-molybdenum-vanadium and nickel-molybdenum. Such activated cathodes are well know and fully described in the art. Other metal cathodes can be in intermetallic mixture or alloy form, such as iron-nickel alloy, or alloys with cobalt, chromium or molybdenum, or the metal of the cathode may essentially comprise nickel, cobalt, molybdenum, vanadium or manganese.

For the diaphragm in the cell, asbestos is a well-known and useful material for making a diaphragm separator. Additionally, synthetic electrolyte permeable diaphragms can be utilized. The diaphragm can be deposited directly on the cathode as disclosed for example in U.S. Pat. No. 4,410,411. Such a deposited diaphragm as therein disclosed can be prepared from asbestos plus a halocarbon binding agent. The asbestos diaphragm for deposit may contain a particulate such as titanium dioxide as disclosed in U.S. Pat.

No. 4,810,345. The synthetic diaphragms generally rely on a synthetic polymeric material, such as polyfluorethylene fiber as disclosed in U.S. Pat. No. 4,606,805 or expanded polytetrafluoroethylene as disclosed in U.S. Pat. No. 5,183,545. Such synthetic diaphragms can contain a water insoluble inorganic particulate, e.g., silicon carbide, or zirconia, as disclosed in U.S. Pat. No. 5,188,712, or talc as taught in U.S. Pat. No. 4,606,805. Of particular interest for the diaphragm is the generally non-asbestos, synthetic fiber diaphragm containing inorganic particulates as disclosed in U.S. Pat. No. 4,853,101. The teachings of this patent are incorporated herein by reference. The foregoing described diaphragms may be referred to herein as "compressible" diaphragms and are to be contrasted with rigid diaphragms, e.g., ceramic diaphragms or the like, which rigid diaphragms can find use in some electrolytic processes.

A synthetic diaphragm may comprise a non-isotropic fibrous mat wherein the fibers of the mat comprise 5–70 weight percent organic halocarbon polymer fiber in adherent combination with about 30–95 weight percent of finely divided inorganic particulates impacted into the fiber during fiber formation. The diaphragm has a weight per unit of surface area of between about 3 to about 12 kilograms per square meter. Preferably, the diaphragm has a weight in the range of about 3–7 kilograms per square meter. A particularly preferred particulate is zirconia. Other metal oxides, i.e., titania, can be used, as well as silicates, such as magnesium silicate and alumino-silicate, aluminates, ceramics, cermets, carbon, and mixtures thereof.

As mentioned hereinabove, the diaphragm is interposed between the anode and the cathode, as by deposition on the cathode followed by the anode being brought up into contact with the deposited diaphragm. Compression can then be exerted on the diaphragm. For this, it is preferred to use expandable anodes such as described for example in U.S. Pat. No. 3,674,676 and U.S. Pat. No. 5,100,525. These anodes have been generally described hereinbefore and have the shape of a box with a rectangular cross-section. The anodes are rather flat, with electrode surfaces affixed to expanders which are kept in a contracted position, such as during cell assembly, by means of suitable retainers. The expanders can be spring connectors, and there can be multiple pairs of such connectors for each box anode. For example, a set of expanders can be placed at, and secured to, the conductor bar of the anode assembly, while an additional set of expanders is situated away from the conductor bar, but placed between parallel anode sheets. This general type of anode is designed to be inserted between cathodes during assembling of the cell. Before start-up, the retainers are removed, the anode electrode surfaces are thereby released and are moved by the action of the expanders against, and compress, the diaphragms. The expandable anodes can be equipped with strong pressing means or springs for this purpose. It is to be understood that pressing means other than springs, e.g., wedges, may be serviceable. The high pressure exerted by the electrode surface of the anode compresses the diaphragm. Usually, the diaphragm will be wetted, as with electrolyte, before the electrode surface is moved against the diaphragm.

Referring then to FIG. 1, there is depicted a graph showing the relation between cell voltage and the anode-cathode gap for a representative chlor-alkali cell utilizing a brine electrolyte and a foraminous metal mesh anode. As can be seen in the figure, the prior art relationship depicted in the representation in FIG. 1. 1 is for a cathode having a deposited diaphragm of 2 mm thickness. Hence the diaphragm does not fill the gap in this representation until the anode is spaced 2 mm from the cathode. Starting from a distance further than 2 mm, as the anode is moved closer to the cathode, the cell voltage proceeds linearly to decrease with the decrease of this gap. For this prior practice, this continues until the anode to cathode gap reaches a certain limit, about 3.5 mm in the figure, whereupon the voltage remains more or less constant until achieving zero gap, i.e., until the anode presses against the diaphragm at 2 mm from the cathode.

As has now been observed, when the diaphragm between the anode and the cathode is a compressed diaphragm and fills the gap, this cell voltage is a decreased cell voltage. Moreover, this decrease extends across the range of the anode-cathode gap in the figure. Thus at the left portion of the figure for the invention, the cell has a gap containing a 2 mm thick diaphragm (uncompressed) that is compressed to a reduced 1 mm thickness between anode and cathode. The right portion of the figure for the invention represents a cell where the gap contains a 6 mm thick diaphragm (uncompressed) which has been compressed to a reduced 5 mm thickness between the anode and the cathode. It will thus be understood that the invention will be particularly useful in applications where the diaphragm is compressed while the anode-cathode distance is decreased below a limit of about 4 mm. It is nevertheless useful beyond this 4 mm limit, as for example, in compressing a diaphragm from a deposit thickness of about 6 mm down to a thickness of about 5 mm or less. Typically, with a modified asbestos diaphragm such as disclosed in U.S. Pat. No. 4,444,640, where the diaphragm has been deposited on a foraminous metal mesh cathode to a thickness of about 6 millimeters, it has been found that the anode can compress such diaphragm to reduce the diaphragm thickness by about 2 millimeters or more. Generally, the thickness reduction for the diaphragm will be a reduction within the range from about 0.5 to about 2 millimeters. Thus, where the thickness of the original diaphragm might be about 3 millimeters, a reduced thickness under compression of 0.5 millimeters results in a compressed diaphragm thickness of about 2.5 millimeters (mm). Where the diaphragm is reduced by compression in thickness by at least about 0.5 mm, such may be referred to herein as a "substantial reduction".

Generally, it is preferable that the foraminous anode have a high surface area and provide a large number of points of contact with the diaphragm. This may be brought about by having a large number of small anode perforations. To achieve this, as with the preferred expanded metal mesh, such mesh can have small apertures, such as a one-sixteenth inch SWD, as mentioned hereinbefore, and, as representative, a one-quarter inch LWD. As an alternative, where the expanded metal mesh has enlarged apertures, e.g., on the order having an LWD of about one-half inch or more and an SWD of about one-quarter inch or more, it is contemplated to utilize this enlarged mesh, or "large void" mesh as an underlayer. Over this underlayer, there is then provided a fine mesh, or small void mesh, overlayer. The fine mesh overlayer then provides the large number of points of contact for the anode with the diaphragm. Such a fine mesh overlayer may have mesh apertures of an about 2 mm SWD, or less, and an about 3 mm LWD, or less. Another aspect of this mesh overlay anode, which is particularly useful for repairing electrodes, can have a new mesh over an old mesh, as disclosed in U.S. Pat. No. 3,940,328.

Where an anode sheet has an underlayer and an overlayer, the overlayer may have little thickness, such as within the range from about 0.1 mm to 0.5 mm, as mentioned hereinbefore. Where such a thin mesh is to serve as an overlayer on an anode sheet, it is desirable to extend the overlayer beyond each edge of the underlayer sheet, and then fold each edge extension over each underlayer sheet edge. By this assembly, where a thin mesh overlayer is used, it may then cover a front face of an underlayer sheet, wrap over each edge of the underlayer sheet and extend around each edge at the back face of the underlayer sheet. By this wrapping, it is contemplated that the fine mesh can be fastened to the underlayer along the extending edges at the back face of the underlayer sheet. Fastening at the front face may also be utilized. In another configuration, it is contemplated that the fine mesh could be folded over on itself to form a folded edge section, at one or more edges of the underlayer sheet. Then this folded edge section can be applied to the face of the underlayer. The resulting anode sheet may then have no edges of the underlayer wrapped with the fine mesh. But, some to all of the faces of the underlayer sheet at its edges may have the fine mesh applied thereto in folded form.

As representative of the electrochemically active coatings that have been mentioned hereinbefore, such as for the foraminous metal anode, are those provided from platinum or other platinum group metals or they can be represented by active oxide coatings such as platinum group metals, magnetite, ferrite, cobalt spinel or mixed metal oxide coatings. Such coatings have typically been developed for use as anode coatings in the industrial electrochemical industry. They may be water based or solvent based, e.g., using alcohol solvent. Suitable coatings of this type have been generally described in one or more of the U.S. Pat. Nos. 3,265,526, 3,632,498, 3,711,385 and 4,528,084, the mixed metal oxide coatings can often include at least one oxide of a valve metal with an oxide of a platinum group metal including platinum, palladium, rhodium, iridium and ruthenium or mixtures of themselves and with other metals. Further coatings include tin oxide, manganese dioxide, lead dioxide, cobalt oxide, ferric oxide, platinate coatings such as $M_xPT_3O_4$ where M is an alkali metal and x is typically targeted at approximately 0.5, nickel-nickel oxide and a mixture of nickel and lanthanum oxides, such as lanthanum nickelate.

EXAMPLE 1

A test was carried out in a diaphragm cell used for the electrolysis of a sodium chloride electrolyte which produced chlorine and caustic soda. The cell was equipped with an anode of the expandable type. The anode was a structure having an underlying sheet of flattened, standard titanium mesh having a thickness of 0.060 inch and with diamond-shaped openings having a long way of design (LWD) of 0.50 inch and a short way of design (SWD) of 0.25 inch. This titanium mesh was coated with an electrocatalytic coating comprising oxides of the platinum group metals. Over a face of this underlying sheet there was welded, using resistance welding, a fine titanium screen, or fine mesh, having a thickness of 0.005 inch and a 60% void fraction. This additional fine mesh was also coated with an electrocatalytic coating comprising oxides of the platinum group metals.

In the test cell, the cathode was a woven steel wire mesh. The cathode had a deposited diaphragm having a matrix of asbestos fibers and a fluorinated binder, which was an SM-2 (Trademark) diaphragm made according to U.S. Pat. No. 4,444,640. The diaphragm had an original thickness of 6 millimeters (mm), measured in dry condition.

In this test cell, or "invention cell", the expandable anode was permitted to press against the diaphragm after it was first wetted by the electrolyte such that the fine mesh on the anode surface was forced into the surface of the diaphragm, i.e., the cell operated at a compressed diaphragm mode, in an amount of about 1 mm compression to a reduced thickness of about 5 mm. During the operation of the test cell, a comparative cell was run concurrently with the test cell. The comparative cell had the additional fine mesh over the standard titanium sheet, but did not have the fine mesh impressed into the cell diaphragm. Rather, the fine mesh was pressed against the diaphragm into zero gap configuration with the diaphragm. The following operating conditions during the test can be reported.

TABLE 1

| CELL | ANODE TO DIAPHRAGM SPACING | VOLTAGE SAVINGS* |
|---|---|---|
| Comparative | Zero Gap | 0 |
| Invention | 1 mm. into the diaphragm | 70 mV |

*For cell operating at 1.6 ASI (amperes per square inch) and 95° C.

EXAMPLE 2

A test was carried out in a cell in a production line which was a commercial chlor-alkali diaphragm cell of the MDC55 type. (Kirk-Othmer, Encyclopedia of Chemical Technology, $4^{th}$ Ed., Vol. 1, pg. 967). The cell was equipped with a dimensionally stable sheet anode of the expandable type. The anode was a sheet of expanded titanium mesh, having a thickness of 0.060 inch. The mesh had diamond-shaped openings having an LWD of 0.5 inch and an SWD of 0.25 inch, respectively. The titanium mesh was coated with an electrocatalytic coating comprising oxides of the platinum group metals.

In the test cell, the operative face of the titanium sheet was covered with the fine mesh of Example 1. This fine mesh was attached to the underlying mesh sheet by welding and it was also coated with an electrocatalytic coating comprising oxides of the platinum group metals. In the test cell, the cathode was made of iron mesh. Onto this cell cathode, there was deposited a diaphragm as described in Example 1. The diaphragm had an original thickness of 6 mm, measured in dry condition.

In the test cell, the fine mesh of the expandable anode was permitted to press against the diaphragm such that the fine mesh on the anode surface was forced into the surface of the diaphragm in an amount of about 1 mm, thereby compressing the diaphragm to a reduced thickness of about 5 mm and providing for cell operation in the compressed diaphragm mode. During the operation of the production line, the other cells running concurrently served as comparative cells. These production cells did not have the additional fine mesh titanium sheet and also did not have the anode impressed into the cell diaphragm. Rather, the production cells operated with a 3 mm gap between the anode and the diaphragm. The following operating conditions during the test can be reported.

TABLE 2

| CELL | ANODE TO DIAPHRAGM SPACING | VOLTAGE SAVINGS* |
|---|---|---|
| Comparative | 3 mm gap | 0 |
| Invention | 1 mm. into the diaphragm | ~100 mV |

*Corrected to operation at 1.55 ASI, 95° C. and production of 150 grams per liter NaOH concentration.

EXAMPLE 3

A test was carried out in a cell in a production line which was a commercial chlor-alkali diaphragm cell of the MDC- 29 type. (Kirk-Othmer, pgs 964–965). The cell was equipped and operated in accordance with the method of Example 2.

In the test cell, the fine mesh of the expandable anode was permitted to press against the diaphragm such that the fine mesh on the anode surface was forced into the surface of the diaphragm in an amount of about 0.5 mm, thereby compressing the diaphragm to a reduced thickness of about 2.5 mm and providing for cell operation in the compressed diaphragm mode. During the operation of the production line, the other cells running concurrently served as comparative cells. These production cells did not have the additional fine mesh titanium sheet and also did not have the anode impressed into the cell diaphragm. Rather, the production cells operated with a 1.5 mm gap between the anode and the diaphragm. The following operating conditions during the test can be reported:

TABLE 3

| CELL | ANODE TO DIAPHRAGM SPACING | VOLTAGE SAVINGS* |
|---|---|---|
| Comparative | 1.5 mm gap | 0 |
| Invention | 0.5 mm. Into the diaphragm | ~100 mV |

*Corrected to operation at 1.55 ASI, 95° C. and production of 150 grams per liter NaOH concentration.

EXAMPLE 4

A test was carried out in a cell in a production line which was a commercial chlor-alkali diaphragm cell of the MDC-55 type. The cell was equipped with a dimensionally stable sheet anode of the expandable type. The anode was a sheet of expanded titanium mesh, having a thickness of 0.060 inch. The mesh had diamond-shaped openings having an LWD of 0.5 inch and an SWD of 0.25 inch, respectively. The titanium mesh was coated with an electrocatalytic coating comprising oxides of the platinum group metals.

In the test cell, the operative face of the titanium sheet was covered with the fine mesh of Example 1. This fine mesh was attached to the underlying mesh sheet by welding and it was also coated with an electrocatalytic coating comprising oxides of the platinum group metals. In the test cell, the cathode was made of iron mesh. Onto this cell cathode, there was deposited a diaphragm as is described in U.S. Pat. No. 4,853,101.

In the test cell, the fine mesh of the expandable anode was permitted to press against the diaphragm such that the fine mesh on the anode surface was forced into the surface of the diaphragm in an amount of about 0.5 mm, thereby compressing the diaphragm to a reduced thickness of about 2.5 mm and providing for cell operation in the compressed diaphragm mode. During operation of the production line, the other cells running concurrently served as comparative cells. These production cells did not have the additional fine mesh titanium sheet and also did not have the anode impressed into the cell diaphragm. Rather, the production cells operated with a 1.5 mm gap between the anode and the diaphragm. The following operating conditions during the test can be reported.

TABLE 4

| CELL | ANODE TO DIAPHRAGM SPACING | VOLTAGE SAVINGS* |
|---|---|---|
| Comparative | 1.5 mm gap | 0 |
| Invention | 0.5 mm. into the diaphragm | ~150 mV |

*Corrected to operation at 1.55 ASI, 95° C. and production of 150 grams per liter NaOH concentration.

What is claimed is:

1. In an electrolytic diaphragm cell for the production of one or more of chlorine, caustic soda and potassium hydroxide, or for the recovery of acid and base values from salts, said cell having a diaphragm interposed between electrodes of said cell, said cell comprising an anode assembly having at least one anode contacting said diaphragm and a cathode assembly having at least one cathode contacting said diaphragm, said anode and said cathode providing an interelectrode gap, which interelectrode gap contains said diaphragm, with the diaphragm having an original and uncompressed thickness within said interelectrode gap as a first thickness, the improvement in said cell comprising a diaphragm which is compressed in said cell by pressing at least one electrode against said diaphragm, which diaphragm is present in said interelectrode gap as a compressed diaphragm of a second, reduced thickness, such that said second reduced thickness reduces said interelectrode gap in an amount within the range from about 0.5 to about 2 mm.

2. The cell of claim 1 wherein said diaphragm is deposited on said cathode, said first diaphragm thickness is an original, uncompressed deposit thickness and said anode in said cell is pressed into said diaphragm to provide a substantial reduction in diaphragm thickness.

3. The cell of claim 1 wherein said compressed diaphragm of a second, reduced thickness reduces said interelectrode gap in an amount within the range from about 0.5 mm to about 2 mm.

4. The cell of claim 1 wherein said diaphragm comprises a compressible asbestos diaphragm.

5. The cell of claim 1 wherein said diaphragm comprises a compressible synthetic diaphragm.

6. The cell of claim 5 wherein said synthetic diaphragm comprises organic polymer fibers which can be in adherent combination with inorganic particulates.

7. The cell of claim 6 wherein said diaphragm comprises a non-isotropic fibrous mat comprising 5–70 weight percent of halocarbon polymer fiber in adherent combination with about 30–95 percent of finely divided inorganic particulate.

8. The cell of claim 1 wherein said anode is a metal anode and said metal anode is a foraminous metal anode.

9. The cell of claim 8 wherein said foraminous metal anode is a foraminous metal mesh anode.

10. The cell of claim 9 wherein said metal mesh anode is an expanded mesh anode made of a large void expanded metal mesh underlayer that is provided with a small void mesh overlayer.

11. The cell of claim 10 wherein one or more of said large void expanded metal mesh and said small void mesh has an electrochemically active coating.

12. The cell of claim 10 wherein said small void mesh overlayer is wrapped over edges of said mesh underlayer.

13. The cell of claim 12 wherein said mesh overlayer has a thickness within the range of from about 0.1 mm to 0.5 mm.

14. The cell of claim 10 wherein said small void mesh overlayer is folded over on itself at its edges and said folded edges are applied against a face of said mesh underlayer.

15. The cell of claim 1 wherein said metal anode is a valve metal anode and the valve metal of said anode is selected from the group consisting of titanium, tantalum, niobium and zirconium, their alloys and intermetallic mixtures.

16. The cell of claim 1 wherein said anode is in the form of a plate, perforate member, rods or blades.

17. The cell of claim 1 wherein said cathode is a metal cathode and said metal cathode is a foraminous metal cathode.

18. The cell of claim 17 wherein the metal of said cathode comprises a metal selected from the group consisting of steel, nickel, their alloys and intermetallic mixtures.

19. The cell of claim 1 wherein said anode is a coated anode coated with an electrochemically active coating.

20. The electrode of claim 19 wherein said electrochemically active coating contains a platinum group metal, or metal oxide or their mixtures.

21. The electrode of claim 19 wherein said electrochemically active coating contains at least one oxide selected from the group consisting of platinum group metal oxides, magnetite, ferrite, cobalt oxide spinel, and tin oxide, and/or contains a mixed crystal material of at least one oxide of a valve metal and at least one oxide of a platinum group metal, and/or contains one or more of manganese dioxide, lead dioxide, platinate substituent, nickel-nickel oxide and nickel plus lanthanide oxides.

22. The cell of claim 1 wherein said first, uncompressed original diaphragm thickness is within the range of from about 3 to about 6 mm and said compressed diaphragm second reduced thickness is within the range from about 2 to about 5.5 mm.

23. The cell of claim 1 comprising an electrode riser, first and second spaced-apart active electrode surfaces on opposite sides of said electrode riser, with each electrode surface comprising at least one electrode sheet, and spring connectors secured to said electrode riser and supporting the electrode sheets.

24. The electrolytic cell of claim 1 for the production of one or more of chlorine, caustic soda and potassium hydroxide, or for the recovery of acid and base values from salts.

25. A method for assembling an electrolytic diaphragm cell for the electrolysis of an aqueous electrolyte, wherein said electrolysis produces one or more of chlorine, caustic soda and potassium hydroxide, which method comprises:

establishing a metal anode;

providing a metal cathode adjacent said anode, said cell having an interelectrode gap between said anode and said cathode;

establishing a diaphragm of a first, original and uncompressed thickness within said interelectrode gap between said anode and said cathode, whereby said diaphragm is deposited on said cathode;

pressing said anode into said deposited diaphragm and compressing said diaphragm to a second, reduced thickness, said reduced thickness in being within the range of from about 2 to about 5.5 mm.

26. The method of claim 25 wherein there is established a plurality of metal anodes and said metal anodes are foraminous metal anodes.

27. The method of claim 25 wherein said diaphragm is deposited on said cathode, said first diaphragm thickness is an original, uncompressed deposit thickness and said anode is pressed into said deposited diaphragm to provide a substantial reduction in diaphragm thickness.

28. The method of claim 25 wherein pressing said electrode against said diaphragm compresses said diaphragm from a first,uncompressed original thickness that is within the range of from about 3 to about 6 mm to said second, reduced thickness that is within the range from about 2 to about 5.5 mm.

29. The method of claim 25 wherein pressing said electrode against said diaphragm compresses said diaphragm and reduces said diaphragm thickness in an amount within the range from about 0.5 mm to about 2 mm.

30. The method of claim 25 wherein said diaphragm comprises a compressible asbestos diaphragm or a compressible synthetic diaphragm.

31. The method of claim 25 wherein there is established a foraminous metal mesh anode that is an anode of a large void expanded metal mesh underlayer having a small void mesh overlayer.

32. The method of claim 25 wherein said electrolysis of said aqueous electrolyte produces one or more of chlorine, caustic soda and potassium hydroxide, or recovers acid and base values from salts.

33. In the process wherein an alkali metal chloride electrolyte is passed into an electrolytic cell and electrolyzed in said cell, and said cell contains a compressible diaphragm positioned between an anode and a cathode, which diaphragm is placed in said cell in a first original uncompressed thickness, the improvement in said process which comprises electrolyzing said electrolyte in the cell to produce caustic at said cathode of said cell and chlorine at said anode of said cell, with the cell containing said diaphragm compressed between said anode and said cathode, which diaphragm is compressed to a second reduced thickness in an amount within the range from about 0.5 mm to about 2 mm.

34. The process of claim 33 wherein said diaphragm is deposited on said cathode, said first diaphragm thickness is an original, uncompressed deposit thickness and said anode is pressed into said deposited diaphragm to provide a substantial reduction in diaphragm thickness.

35. The process of claim 33 further comprising:

pressing said anode into said diaphragm to provide said reduced diaphragm thickness; and maintaining said diaphragm in said reduced thickness; while continuing electrolysis of said electrolyte in said cell.

36. The process of claim 33 wherein said cell has a diaphragm placed in said cell in a first, original and uncompressed diaphragm thickness within the range of from about 3 to about 6 mm, which diaphragm is compressed to a reduced thickness within the range from about 2 to about 5.5 mm.

37. The process of claim 33 wherein said compressed diaphragm of a second, reduced thickness reduces said diaphragm thickness in an amount within the range from about 0.5 mm to about 2 mm.

38. The process of claim 33 wherein said diaphragm compressed to a second reduced thickness comprises a compressible asbestos diaphragm or a compressible synthetic diaphragm.

39. The process of claim 33 for the production of chlorine and caustic wherein an alkali metal chloride electrolyte is electrolyzed and caustic is produced at the cathode of the cell and chlorine is produced at the anode of the cell.

40. The process of claim 33 for the production of one or more of chlorine, caustic soda and potassium hydroxide or for the recovery of acid and base values from salts.

* * * * *